US005680328A

United States Patent [19]

Skorupski et al.

[11] Patent Number: 5,680,328

[45] Date of Patent: Oct. 21, 1997

[54] COMPUTER ASSISTED DRIVER VEHICLE INSPECTION REPORTING SYSTEM

[75] Inventors: Jeffrey H. Skorupski, Kalamazoo, Mich.; William H. Lueckenbach, Lewisville, N.C.

[73] Assignee: Eaton Corporation, Cleveland, Ohio

[21] Appl. No.: 445,832

[22] Filed: May 22, 1995

[51] Int. Cl.[6] ..... G06G 7/00

[52] U.S. Cl. ..... 364/550; 364/424.034; 364/424.037; 364/424.035; 364/424.04; 364/551.01

[58] Field of Search ..... 364/550, 424.04, 364/424.034, 424.037, 424.035, 423.098, 551.01; 340/430, 438, 426, 459

[56] References Cited

U.S. PATENT DOCUMENTS

| | | | |
|---|---|---|---|
| 4,025,791 | 5/1977 | Lennington et al. | 250/341 |
| 4,258,421 | 3/1981 | Juhasz et al. | 364/424 |
| 4,658,371 | 4/1987 | Walsh et al. | 364/550 |
| 4,728,922 | 3/1988 | Christen et al. | 340/991 |
| 4,763,356 | 8/1988 | Day, Jr. et al. | 379/368 |
| 4,804,937 | 2/1989 | Barbiaux et al. | 340/459 |
| 5,058,044 | 10/1991 | Stewart et al. | 364/551.01 |
| 5,459,304 | 10/1995 | Eisenmann | 235/380 |
| 5,499,181 | 3/1996 | Smith | 364/424.04 |
| 5,550,738 | 8/1996 | Bailey et al. | 364/424.04 |
| 5,557,254 | 9/1996 | Johnson et al. | 340/426 |
| 5,557,268 | 9/1996 | Hughes et al. | 340/933 |

OTHER PUBLICATIONS

Ronald K. Jurgen, "Less sizzle, more beef for Detroit in '86", IEEE Spectrum Oct. 1985, pp. 77–83 Oct. 1985.

*Primary Examiner*—James P. Trammell
*Assistant Examiner*—Demetra R. Smith
*Attorney, Agent, or Firm*—Loren H. Uthoff, Jr.

[57] ABSTRACT

A computerized electronic system (10) for use in conjunction with a fleet of vehicles for complying with pre- and post-trip vehicle inspection reporting requirements while improving fleet maintenance and operations efficiency. An on-board computer (OBC) (12) having integrated or interfaced communications capability is used to receive and store data input by the driver and maintenance personnel. The OBC (12) may electronically store at least the current driver's inspection report and previous driver's inspection report to satisfy regulatory requirements. A copy of these reports can be produced on the vehicle in either electronic or paper form as required by an inspector. A ground support system (GSS) (16) may receive certain inspection information from an OBC (12) on a real time basis and thereby is provided ready access to pertinent vehicle data. The GSS provides necessary archival capabilities as well as use of the OBC data to automate routing and maintenance scheduling as well as to generate statistical information.

18 Claims, 4 Drawing Sheets

FIG 1
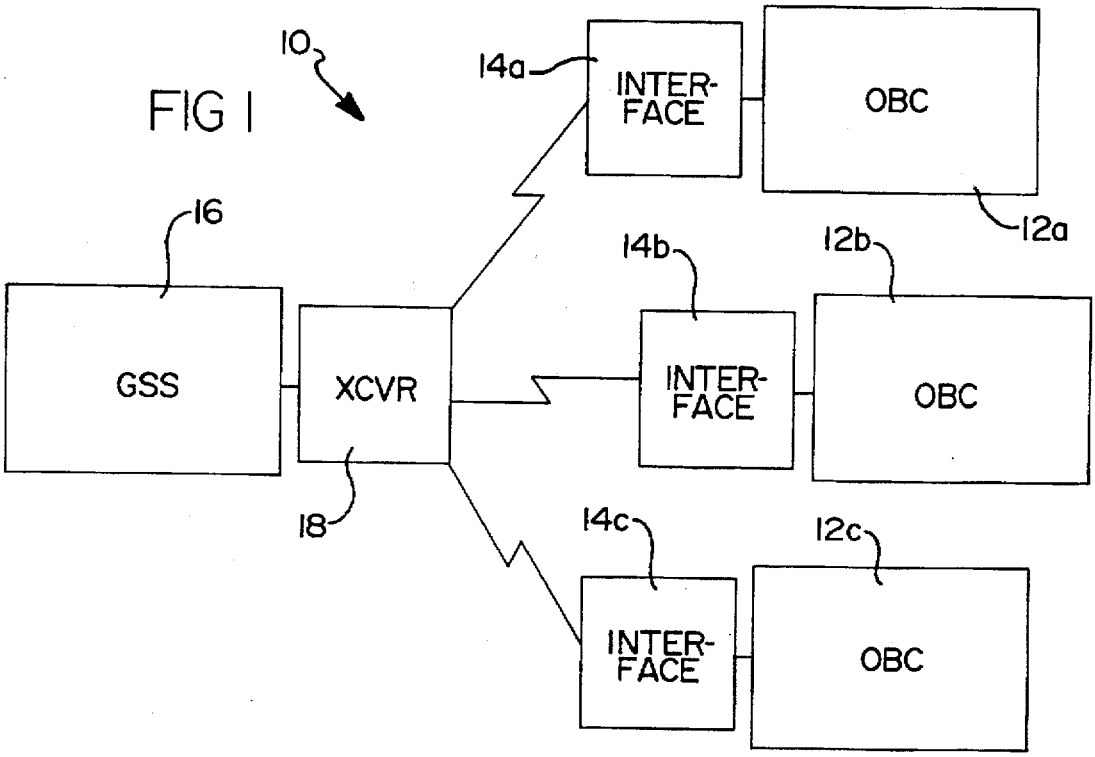
FIG 2
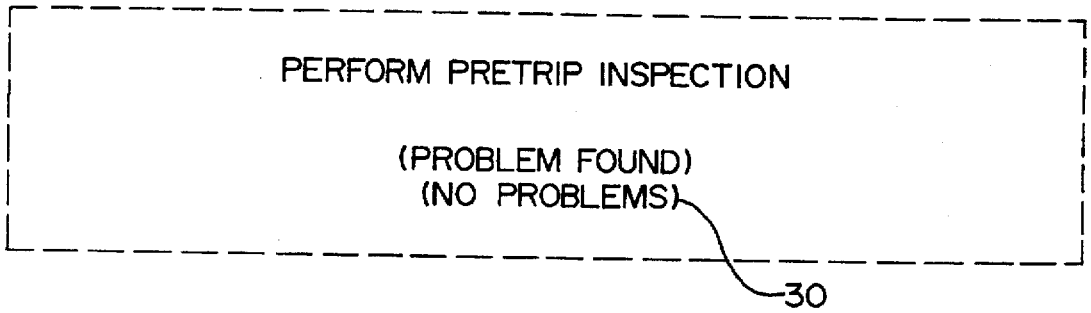
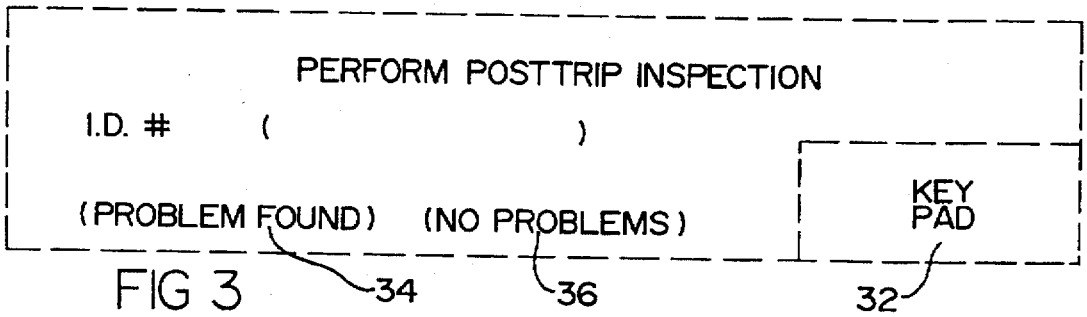
FIG 3

FIG 4

+++ DVIR ENGINE SCREEN +++

(OVERHEATING) (OIL LEAKING) (OIL CONSUMPTION
(OIL PRESSURE LOSS) (NO POWER) (KNOCKS)
(NOISY) (LOPES) (OTHER)

(OK) (CANCEL)

FIG 5

+++ DVIR TRANSMISSION SCREEN +++

(NOISY) (DISENGAGES) (HARD SHIFTING)
(OIL LEAKING) (OTHER)

(OK) (CANCEL)

FIG 6

+++ DVIR SAFETY EQUIPMENT SCREEN +++

(FLAGS – FUSES & FLARES) (SPARE BULBS)
(FIRE EXTINGUISHER) (TRIP REPORT BOOK)

(OK) (CANCEL)

FIG 7

+++ DVIR CLUTCH SCREEN +++

(POOR RELEASE) (GRABS) (SLIPS)
(CHATTERS) (OTHER)

(OK) (CANCEL)

FIG 8

+++ DVIR SCREEN TWO +++

(ENGINE) (CLUTCH) (TRANS'N) (FRONT AXLE)
(REAR AXLE) (STEERING) (ELECTRICAL) (SAFETY EQUIP.)
(COOLING) (BRAKES) (AIR EQUIP.) (FUEL & EXHST)

(OK) (CANCEL)

FIG 9

+++ DVIR STEERING SCREEN +++

(SHIMMY-WANDER) (HARD STEERING) (FREE PLAY)
(OTHER)

(OK) (CANCEL)

FIG 10

+++ DVIR BRAKES SCREEN +++

(AIR PRESSURE) (PEDAL TRAVEL) (GRAB)
(WON'T RELEASE) (POOR) (OTHER)

(OK) (CANCEL)

FIG 11

+++ DVIR ELECTRICAL SCREEN +++

(HEADLIGHTS) (PARKING LIGHTS) (BATTERY)
(HORN) (GENERATOR) (SWITCHES)
(INSTRUMENTS) (WIRING) (LEFT TURN SIG)
(RIGHT TURN SIG) (OTHER)

(OK) (CANCEL)

FIG 12

+++ DVIR FRONT AXLE SCREEN +++

(ALIGNMENT) (WHEEL BALANCE) (TIRE WEAR)
(OTHER)

(OK) (CANCEL)

FIG 13

+++ DVIR REAR AXLE SCREEN +++

(NOISY) (HIGH SPEED) (LOW SPEED)
(COASTING) (PULLING) (OIL LEAKING)

(OK) (CANCEL)

FIG 14

+++ DVIR AIR EQUIPMENT SCREEN +++

(STARTER) (AIR COMPRESSOR) (AIR LINES)
(AIR COUPLERS) (AIR W/S WIPERS) (OTHER)

(OK) (CANCEL)

FIG 15

+++ DVIR COOLING SCREEN +++

(OVERHEATING) (RADIATOR LEAKS) (WATER PUMP LEAKS)
(RUNNING COLD) (OTHER)

(OK) (CANCEL)

COMPUTER ASSISTED DRIVER VEHICLE INSPECTION REPORTING SYSTEM

BACKGROUND OF THE INVENTION

This invention relates generally to an electronic system to be used by commercial vehicle drivers and mechanics to record and report mandatory vehicle inspection and repair information.

Federal law currently requires that commercial trucking operations comply with certain record keeping procedures that include the creation of pre-trip and post-trip vehicle inspection reports and the maintenance of vehicle service information. For instance, a driver must inspect a vehicle at the beginning of each driving shift and for a specified time period thereafter a signed report of his findings must be producible upon demand. Similarly, repair and service information must also be kept and be produced upon demand. Current methods of complying with these procedures generally involve the maintenance of a coupon book in which the necessary forms are bound together, filled out as necessary by the driver and repair personnel, and kept on board the vehicle and in the maintenance shop or trucking office for predetermined periods of time.

However, use of this manual coupon book system is often burdensome and time consuming. The multi-copy forms must be filled out and retained and may be susceptible to damage and loss. The forms must be manually taken to the dispatcher for his use and subsequent archival storage. While they contain a detailed record of vehicle problems and other relevant information, they are in hard copy form and therefore the information contained therein is somewhat inaccessible. These hard copies must also eventually be purged.

Thus, there exists a need to simplify and automate the pre- and post-trip inspection reporting process, and in particular that federally mandated under 49 C.F.R. §396.11–13. In addition, it would also be desirable to make certain information contained in the reports available to fleet operations as soon as possible in order to determine the availability of vehicles for pickup and delivery scheduling, maintenance scheduling and other similar tasks. Storing this data in electronic form further enables statistical calculations and record keeping which is cumbersome with manually filled out paper forms.

SUMMARY OF THE INVENTION

The present invention addresses this need by providing a computerized electronic system for complying with federal inspection reporting requirements as well as for streamlining fleet maintenance operations. An interactive on-board computer (OBC) having integrated or interconnected mobile data communications capability is used to receive data input by the driver and appropriate maintenance personnel, as well as that from various sensors which may also be placed in the vehicle. A ground support system (GSS) computer, typically at the fleet base station or dispatch center, receives certain types of information upon input into the on-board computer and thereby has ready access to pertinent vehicle information. Mandatory signature verification is performed using suitable driver and mechanic identification codes, or other similar systems such as voice recognition or magnetically encoded badges or tags.

The OBC may electronically store, or otherwise be provided with access to, the previous driver's inspection report and the current driver's inspection report to satisfy regulatory requirements. A copy, in electronic or paper form (such as that brought up on an OBC display screen or created utilizing an on-board printer connected to the OBC), can be reproduced on the vehicle by the OBC as required by an inspector. The GSS, or an interconnected management information system (MIS) computer, or suitable magnetic storage media such as a disk or tape, will store the required three months accumulation of vehicle inspection reports for each vehicle in a fleet.

In addition to providing a convenient method for facilitating required pre- and post-trip inspection recording procedures, the system of the present invention further immediately provides all data in electronic form for quick processing in other interconnected computer systems and for permanent record keeping. As large quantities of such information on paper requires significant storage space and is susceptible to fire as well as damage from water and age, the electronic information obtained directly without a separate inputting process significantly reduces this record keeping burden. Defect repair and reporting procedures will be similarly further streamlined. This trip inspection reporting information can also be made available to various types of intelligent vehicle highway systems, such as for use by border and state line crossing stations and other vehicle inspection points, via wireless transmission.

These and other features and advantages of the present invention will become apparent from the following description taken in conjunction with the accompanying drawings.

BRIEF DESCRIPTION OF THE DRAWINGS

FIG. 1 is a schematic diagram of the system of the present invention.

FIGS. 2–15 illustrate sample screen displays generated by the system shown in FIG. 1.

DETAILED DESCRIPTION OF THE PREFERRED EMBODIMENT

Turning now to the drawings, and in particular to FIG. 1, the system of the present invention is indicated generally at 10. System 10 includes three fundamental types of components, on-board computers (OBCs), ground support stations (GSSs) and wireless data communication devices. Each OBC 12 is mounted in a truck or other vehicle, or alternately is portable but remains assigned to a particular vehicle, and preferably is a personal or laptop type computer, or other similar relatively small microprocessor-based system having at least a minimum of data storage memory.

A typical system configuration preferably includes multiple OBCs, denoted herein as 12*a*, 12*b* and 12*c*, each mounted or assigned to a separate vehicle of the fleet. Each OBC 12 includes a communication interface means 14 to support preferably bi-directional communication with a ground support system (GSS) 16, and for that purpose preferably includes a communication port and transceiver to facilitate the transmission and receipt of electronic data such as via radio frequency (rf) or other wireless communication medium. For this purpose, GSS 16 also preferably includes a suitable transceiver 18. This communication between each OBC 12 and a GSS 16 could alternately be provided in the form of portable data cards or other physical memory devices which, although possibly less expensive, do not provide the real time updates possible with rf or similar communication capability and still require the driver to manually transport the inspection report information to the shop.

A typical system may include several GSS stations interconnected to a central management information system (MIS) computer 19 or shop computer 21 wherein each OBC communicates with one or even all of the GSS stations. Since the GSS and MIS stations are stationary, however, this communication may be over phoneline modem or other wirebased system without causing any detriment to system performance. Depending upon the size of a fleet or group of vehicles to be managed with the system of the present invention, each OBC 12 communicates with one or more GSS computers 16 and each GSS with multiple vehicles. If the operation covers a broad geographic area, an entire country for example, an OBC 12 traversing the country may be adapted to sequentially communicate with various ground stations along the way.

OBC 12 also preferably includes at least one input device such as a keyboard, mouse, trackball or tablet. To facilitate the most convenient use by even unskilled computer operators, this device is preferably a touchscreen which also functions as a display screen. OBC 12 is positioned in the vehicle passenger compartment at a point most convenient for potential users, both the driver and other personnel such as maintenance and service persons. The OBC may be completely portable but retained in a cradle or docking device when the vehicle is moving. OBC 12 is also preferably of a type suited for use on-board a vehicle and thus is resilient to heat, vibration and other conditions imposed by a moving vehicle and therefore is preferably properly mounted and may also be integrally packaged in an environmentally hardened enclosure.

System 10 is preferably configured to electronically provide a number of functions, some specifically mandated by statute and others optionally provided to further enhance the usefulness of the system. To this end, OBC 12 preferably includes a display screen, with OBC 12 preferably programmed with specialized menu software to systematically prompt a user for information via the display screen. This eliminates the need for the driver to memorize all required inputs and helps to prevent any inadvertent failure to enter required information. OBC 12 may also be programmed to allow a ground support system 16 to remotely add, delete or alter certain menu screens. It may also be desirable to permit the GSS 16 to cause an alert signal such as a beep to prompt the driver for additional input. OBC 12 may also include one or more data input ports for receiving signals from sensors installed on the vehicle which monitor such parameters as vehicle and engine speed, brake system pressure, etc. An interconnected printer 24 is also preferably provided in order to produce printed copies of reports from the vehicle.

System 10 is preferably configured to meet all federal commercial vehicle inspection recording statutory requirements. According to present federal statutes, a truck driver, upon demand, must be able to produce the previous or current inspection report for that vehicle. This information is thus preferably stored in the memory of OBC 12 for instant access, or in a portable memory device such as a PCMCIA card which is kept on the vehicle for the requisite period. Alternately, however, the current or previous inspection report information may be stored in GSS 16 and sent to OBC 12 only upon demand, thus eliminating the need for memory capacity in OBC 12. Similarly, the mandatory three months worth of previous reports are preferably archived in at least one of GSS 16, a main MIS computer or on disk or tape. The current inspection report information must be available on demand for presentation via printer 24 or other suitable output means such as display screen. In addition, it may be output in an electronic form as a signal transmittable to some remote station for hardcopy output such as via a remote terminal or printer.

To satisfy current federal requirements, the information presented in this report must include the results of a post-trip vehicle inspection report performed by the previous driver. Specific report entries must include the previous driver's identification (I.D.) sign-off, typically in the form of a signature, and date as well as a description of any problems encountered. If there were problems reported which were repaired, the report must further include the I.D. of the mechanic performing the repair, also typically a signature, and accompanying date. If service work was performed to fix any reported problems, the present vehicle driver's verification of an acceptable repair including the driver's identification and date and the vehicle identification number (preferably stored in the memory of OBC 12) must further be included.

In order to provide the statutorily required driver or mechanic identification without necessitating the production of a hard paper copy which can be signed as necessary, a confidential code assigned to that person may be required to be input. Alternately, OBC 12 may include a tablet adapted to electronically record the image of a signature created with an electronic pen. An additional means for providing the required identification can also be accomplished with a "voice signature". In this regard OBC 12 can include a card or appropriate integrated circuitry and connected microphone for accepting a voice signature and converting it to digital information in any suitable fashion known to those having skill in the art. The OBC 12 would also preferably perform comparison of the input signature to a stored signature which could also be used for security purposes to control access to OBC 12 and also to selectively control certain vehicle functions such as starting the engine. The same type of functions could alternately be performed with a means to read a magnetically or optically encoded badge or I.D. card.

With the hardware of system 10, in conjunction with the provision of appropriate software, preferably run mainly on the processor of each OBC 12, numerous inspection scenarios could be created, the first being a pre-trip inspection wherein no defects were reported on the previous trip and wherein no defects are found by the driver before beginning a new trip. A display screen provided on OBC 12 to initiate a pre-trip inspection report such as that shown in FIG. 2 could be presented to the driver after he logs on or accesses the system 10 via OBC 12. In this instance there would be no data that would need to be entered into OBC 12 by the driver before beginning his trip and he could select the "no problems" indicator 30 on the screen.

If, however, a driver did happen to discover a defect in performing his pre-trip inspection, he would need to enter the nature of the defect into OBC 12. A sequence of user-friendly menus, such as the exemplary display screens shown in FIGS. 4–15, (or suitable icons) are preferably presented on the OBC in order to prompt the driver for the particular problem encountered. For instance, a general vehicle problem area, such as engine or brakes, may be selected by touching the appropriate indication on the screen display shown in FIG. 9. From there more detailed menus would be presented in a hierarchical fashion, such as for instance, specific engine problems (FIG. 4), transmission problems (FIG. 5), and so forth. The menus are preferably constructed so as to facilitate the reporting of multiple defects in various vehicle systems in a single session. The screens, as a minimum, would subscribe to federally mandated reporting criteria with additional data added as required by the state on the fleet or truck user/owners.

Subject to predefined discrimination criteria, preferably stored in OBC 12, appropriate personnel or systems, such as a shop supervisor, dispatcher, or scheduling computer could be notified immediately if the defect is of a type which is required to be corrected before the vehicle is operated. This information can be used for vehicle re-assignment by the dispatcher and to remove the vehicle from further routing and scheduling until the driver reported defect(s) are corrected. All data related to driver inspections is also preferably entered into a database for use in simplifying additional tasks such as maintenance scheduling, generating work orders, inventory and statistical record keeping.

Once a mechanic has remedied the problem, he must also enter that fact into OBC 12 along with personal identification such as a code or voice signature. This information can be entered into any one of OBC 12, a separate shop computer or a ground support station computer 16 if the shop computer is interconnected to the GSS. The driver, after logging on for the next trip on the repaired vehicle, will be prompted by OBC 12 to verify that the reported defects have been corrected and will then be requested to enter his identification.

Post-trip inspections are preferably handled in a similar manner such as with the screen display illustrated in FIG. 3. Using this screen a driver enters his I.D., preferably through numbers or letters presented on the screen as a key pad 32, and selects either "problem found" 34 or "no problems" 36. Problems found, especially in safety or other equipment which could cause the vehicle to necessarily be removed from service until the problem is repaired, could be transmitted immediately to a GSS 16.

If a driver identifies a problem on his post-trip inspection and repairs are performed on the vehicle to correct the problem, the next driver will be prompted by OBC 12 to confirm that the repairs were completed satisfactorily. This information could also be uploaded to GSS 16 on a real time basis. To accomplish this OBC 12 preferably presents the new driver with an appropriate screen after log on, prior to allowing the new driver to enter his pre-trip inspection results. Preferably, this screen contains at least the previous driver's sign off and date, a brief description of the problem (s) reported by the previous driver, a mechanic's identification verifying that service work was performed to fix the reported problem and date, an entry for the present driver's sign-off and the date. Only once the driver completes the query regarding the previous defect can he begin entering data pertaining to his own pre-trip inspection.

The software running on system 10 also preferably provides numerous other capabilities as well as accompanying menu screens. Other functions to be provided could include, for instance, en route defect reporting, route status and trip reporting, data transmission (such as to GSS 16) options, interfaces to other related systems such as a maintenance management system and numerous report printing options. In addition, system 10 can be programmed to be "smart" in that it would "know" certain information about the vehicle such as the type of transmission or could determine whether a trailer is present and automatically invoke certain display screens based on this knowledge. This information could be provided to an OBC 12 from various vehicle system control modules, sensors placed on the vehicle and interconnected to OBC 12 or, alternately, preprogrammed or downloaded from a GSS 16.

Thus system 10 provides a convenient and effective means for complying with federal regulations regarding vehicle pre- and post-trip inspection reporting while also providing several advantageous features not heretofore possible with manual trip inspection reporting systems. Multi-copy paper forms can be eliminated and relevant data transmitted in real time to a fleet dispatch or other base office. Data stored in electronic form further enables statistical record keeping not feasible with manually kept records.

The foregoing discussion discloses and describes an exemplary embodiment of the present invention. One skilled in the art will readily recognize from such discussion, and from the accompanying drawings and appended claims, that certain changes, modifications and variations can be made therein without departing from the spirit and scope of the invention as defined in the following claims.

What is claimed is:

1. An electronic pre- and post-trip inspection reporting system for a fleet of vehicles comprising:

an on-board computer associated with at least one of said vehicles in said fleet, said on-board computer including means for receiving data input by the previous driver of said vehicle, a service person who has serviced said vehicle in response to an input of said previous driver and a next driver, said processor being adapted for:

receiving data input by said previous driver of said vehicle, said data including a unique identifier assigned to said previous driver and indication of vehicle problems known to said previous driver, and for a response by said previous driver indicative of a known vehicle problem;

receiving data input by said service person, said data including a unique identifier assigned to said service person and confirmation that said indicated problem has been resolved; and receiving data input by a next driver of said vehicle, said data including confirmation that said problem has been resolved; and receiving data input by said next driver of said vehicle, said data including a unique identifier assigned to said next driver;

at least one ground station computer installed at a base for said fleet of vehicles; and data communication means for transmitting said data entered into said on-board computer to said ground station computer.

2. The electronic trip inspection reporting system of claim 1 wherein said on-board computer further comprises a data storage memory.

3. The electronic trip inspection reporting system of claim 1 wherein said data communication means includes at least one radio frequency transceiver.

4. The electronic trip inspection reporting system of claim 1 wherein said data communication means includes a portable data card.

5. The electronic trip inspection reporting system of claim 1 wherein said means for receiving and storing data includes a touchscreen.

6. The electronic trip inspection reporting system of claim 1 wherein said data input into said on-board computer pertaining to said identification includes a numerical sequence unique to each driver or service person.

7. The electronic trip reporting system of claim 1 wherein said on-board computer further includes magnetic or optical badge recognition means for performing said identification.

8. The electronic trip reporting system of claim 7 wherein said ground station computer includes a magnetic or optical badge recognition means.

9. The electronic trip reporting system of claim 1 wherein said on-board computer further includes means for performing voice recognition and said identification is vocal.

10. The electronic trip reporting system of claim 9 wherein said voice recognition means is further connected to a vehicle security system.

11. The electronic trip reporting system of claim 10 wherein said vehicle security system prevents the vehicle from being driven until an inspection report is completed.

12. The electronic trip reporting system of claim 1 further comprising data communication means for transmitting data and commands from said ground station computer to at least one said on-board computer.

13. The electronic trip reporting system of claim 12 wherein said means for transmitting data includes at least one radio frequency transceiver.

14. The electronic trip reporting system of claim 13 wherein said ground station computer includes means for remotely altering software running on at least one said on-board computer.

15. The electronic trip reporting system of claim 1 wherein said on-board computer includes a printer.

16. A method of providing pre- and post-trip inspection reports for a fleet of vehicles comprising the steps:

providing a computer on at least one said vehicle in said fleet, said computer having means for receiving and storing input data;

querying a previous driver of said vehicle for a unique identifier assigned to said previous driver and for indication of vehicle problems known to said previous driver;

for a response by said previous driver indicative of a known vehicle problem:

querying a service person for a unique identifier assigned to said service person and for confirmation that said indicated problem has been resolved; and querying a next driver of said vehicle for confirmation that said problem has been resolved; and querying said next driver of said vehicle for a unique identifier assigned to said next driver;

providing a ground station computer; and transmitting said input data to said ground station computer.

17. The method of claim 16 further comprising the step of storing said input data in said vehicle computer for a predetermined period of time.

18. The method of claim 16 further comprising the step of providing print capability on said vehicle computer.

* * * * *